US005231458A

United States Patent [19]

Nishimura

[11] Patent Number: 5,231,458

[45] Date of Patent: Jul. 27, 1993

[54] PRINTER WHICH UTILIZES PREVIOUSLY USED DEVELOPER

[75] Inventor: Soichiro Nishimura, Nagoya, Japan

[73] Assignee: Brother Kogyo Kabushiki Kaisha, Nagoya, Japan

[21] Appl. No.: 907,051

[22] Filed: Jul. 1, 1992

[30] Foreign Application Priority Data

Jul. 15, 1991 [JP] Japan ..... 3-201489

[51] Int. Cl.[5] ..... G03G 15/20

[52] U.S. Cl. ..... 355/298

[58] Field of Search ..... 355/296, 298, 299, 215, 355/301, 305, 245; 118/653

[56] References Cited

U.S. PATENT DOCUMENTS 4,376,578 3/1983 Tanaka et al. ..... 355/299 X
4,462,677 7/1984 Onoda .
4,696,565 9/1987 Imanaka ..... 355/298
4,894,688 1/1990 Taniguchi et al. ..... 355/298
4,958,197 9/1990 Kinashi et al. ..... 355/299
5,040,022 8/1991 Kinoshita et al. ..... 355/206
5,128,724 7/1992 Hayashi et al. ..... 355/298

*Primary Examiner*—A. T. Grimley
*Assistant Examiner*—Sandra L. Brasé
*Attorney, Agent, or Firm*—Oliff & Berridge

[57] ABSTRACT

In a printer capable of developing a beautiful image even if waste toner particles are utilized repeatedly for development, residual magnetic toner particles on a photosensitive drum are collected in a cleaning device and returned to a development device by a collecting auger and a carrier auger through a toner particle carrying path. In the development device, the magnetic toner particles are carried into a development area for subsequent developing by a developing sleeve. Just before the development area, toner particles and additives on the toner surface which are not suitable for development contained in the collected waste toner particles are selectively collected by a bias applying roller which is provided between the developing sleeve and the photosensitive drum.

18 Claims, 6 Drawing Sheets

PRINTER WHICH UTILIZES PREVIOUSLY USED DEVELOPER

BACKGROUND OF THE INVENTION

1. Field of the Invention

The present invention relates to a printer having a development device for developing an electrostatic latent image on a photosensitive body to create a visible image, which is used for an electrophotographic apparatus, etc., and more particularly to a printer which utilizes previously used development toner particles.

2. Description of Related Art

A conventional process unit adopting a conventional toner particle collecting method which is used for the electrophotographic apparatus will be explained with reference to FIG. 5 and FIG. 6. A process unit 30 installed on the electrophotographic apparatus main body is supported by a case 32 which is in the apparatus. This process unit 30 includes a photosensitive drum 33, a scorotron charger 34, a development device 36, and a cleaning device 38. The photosensitive drum 33 is formed by a cylinder-type conductive base substance such as aluminum on which photoconductive material is coated. The scorotron charger 34, a light scanning device 35, the development device 36, a corotron transfer device 37, and the cleaning device 38 are arranged according to the rotational direction indicated by the arrow Y in FIG. 5 around the photosensitive drum 33.

The development device 36 stores magnetic toner particles 39 and has a developing sleeve 40 which rotates in a direction indicated by the arrow X in FIG. 5, and carries the magnetic toner particles 39 to the photosensitive drum 33 when a latent image on the drum 33 is developed. A magnet roll 41 is arranged in the developing sleeve 40. The magnet roll 41 is supported to rotate around the same shaft as the developing sleeve 40 in an opposite direction indicated by the arrow V in FIG. 5. Further, the development device 36 has a trimming blade 42 which restricts the toner particles layer thickness on the developing sleeve 40. Moreover, a power supply 47 is provided for applying a voltage to the developing sleeve 40. The cleaning device 38 contains a cleaning blade 48 for removing residual toner particles on the photosensitive drum 33, an agitator 49, and a cleaning box 50 which supports the above blade 48 and the agitator 49 and stores the removed toner particles therein.

The magnetic toner particles 39 are particles whose average particle diameter is about 10 microns. Magnetic powder such as ferrite which is dispersed between 10 and 65 percentage by weight in a styrene-acrylic copolymer resin, carbon black as a coloring agent, and an acceptor such as azo dye contained metal, chlorinated paraffin, and chlorinated polyester for providing negative electrification are included therein. Moreover, various additives are adhered on the surface of the toner particles in order to shorten the time taken for the amount of charge of the toner particles to reach a predetermined value and to maintain the predetermined amount of charge. In order to adhere these additives on the surface of the negatively-charged toner particles, the electrified polarity of the additives on the toner surface is slightly charged positively and the additives on the toner surface are charged in an opposite polarity to the polarity of the magnetic toner particles 39. The following materials are used as the additives on the toner surface. For instance, inorganic corpuscles such as colloidal silica and zinc oxide; contained organic particles such as magnetic grain, polymer beads and polyvinylidene fluoride; fatty acid metal salts such as stearin acid zinc; and black pigments such as carbon black are used.

Next, the movement of the electrophotographic apparatus on which the above-mentioned process unit 30 is installed is explained. First, the surface of the photosensitive drum 33 is uniformly charged to a predetermined polarity and potential by the scorotron charger 34. The light scanning device 35 exposes the photosensitive drum 33 based on an image signal from a control device 35A, and an electrostatic latent image is formed on the photosensitive drum 33. This latent image is developed to create a visible image by the development device 36, and the visible image is transferred on a sheet 55 by the corotron transfer device 37. The image transferred on the sheet 55 is fixed with a fixing device 56 and is output from a sheet outlet (not shown). On the other hand, foreign matters such as residual toner particles adhered on the surface of the photosensitive drum 33 after transfer and paper powder from the sheet 55 are removed by the cleaning device 38, and the photosensitive drum 33 is charged again by the scorotron charger 34 and the above-described movement is repeated.

The residual toner particles on the photosensitive drum 33 are scratched with the cleaning blade 48, and fall into the cleaning box 50. The cleaning blade 48, which is formed of an excellent polyurethane rubber in the ozonization resistance and the abrasion resistance is used, and its edge is finished to uniformly contact the surface of the drum 33. Further, a free edge of the cleaning blade 48 is arranged to extend in a direction reverse to the rotating direction indicated by the arrow Y of the photosensitive drum 33, and the toner particles on the photosensitive drum 33 can be scratched and removed by applying constant pressure to the cleaning blade 48. The toner particles which fall in the cleaning box 50 are carried into an inner part of the cleaning box 50 by rotation of an agitator 49 in the direction indicated by the arrow W and are stored therein.

In the process unit thus constructed, the waste toner removed from the photosensitive drum is returned to the development device and is utilized again for using this waste toner effectively.

Construction and movement to return the waste toner in the cleaning box to the development device are explained as follows. A collecting auger 51 is provided in the cleaning box 50, and a collecting container 52 is provided on the side of the cleaning box 50. Moreover, a toner particle carrying path 53 is provided between the collecting container 52 and the development device 36, and a carrier auger 54 is provided in the toner particle carrying path 53. Each of the collecting auger 51 and the carrier auger 54 is driven by a collecting auger drive motor 51A and a carrier auger drive motor 54A, respectively. The waste toner saved in the cleaning box 50 is carried into the collecting container 52 by the collecting auger 51, and further, is returned to the development device 36 through the toner particle carrying path 53 by the carrier auger 54 for use for development again. The amount of wasted toner particles can be greatly reduced by utilizing the waste toner again as mentioned above, and it can contribute to save resources.

However, the following problems are caused in the conventional development device thus constructed.

That is, when the electrostatic latent image formed on the photosensitive drum is developed to a visible image by the toner particles, the additives on the surface of the toner particles are charged to a polarity which is opposite to the polarity of the toner particles. Therefore, in general, the additives are easily transferred even if they are adhered in the non-image portion on the photosensitive body when developed, removed by the mechanical and electrical power in the developing part, and dropped and collected in the cleaning box 50. Therefore, the amount of the additives in the waste toner stored in the cleaning box 50 increases compared with the toner particles of an initial condition. Then, if development is performed using the waste toner which is not suitable for development, the additives adhere to the non-image portion on the photosensitive body. As a result, the additives adhere to the blank of the sheet and the image defect such as dirt on the sheet becomes evident, which does not happen when using new toner particles. Moreover, foreign matter such as the paper powder from sheet 55 are admixed in the waste toner. They also make the image dirty.

SUMMARY OF THE INVENTION

An object of the present invention is to provide a printer having a process unit which can obtain beautiful images even if it utilizes waste toner particles for developing, by selectively removing from the waste toner particles an element which is not suitable for development, the waste toner particles having been previously used for developing.

In order to achieve this object, the process unit of the present invention comprises: a photosensitive drum, an exposure unit for making a latent image on the photosensitive drum, a development unit for developing the latent image on the photosensitive drum to create a visible image by using developer, a cleaning unit for removing residual developer on the photosensitive drum after developing and for storing the removed developer therein, a carrying unit for carrying the developer in the cleaning unit into the development unit, a conveying unit for conveying the developers, which are carried to the development unit by the carrying unit, near the photosensitive drum, and a collecting unit for selectively collecting an element present which is not suitable for development from the developer carried by the carrying unit to the development unit.

In the printer of the present invention having the process unit thus constructed, magnetic or non-magnetic toner particles which are removed by the cleaning device and carried into the development device are again utilized to develop the electrostatic latent image on the image forming apparatus body to a visible image. When waste toner particles are carried near an image forming apparatus body by a toner supplying unit, an element present which is not suitable for development in the waste toner particles which are in the toner supplying unit is selectively collected by the collecting unit.

According to the printer of the present invention having the process unit thus constructed, an element present in the waste toner particles which is not suitable for development which are collected after being previously used for development is selectively removed. Therefore, in comparison with the conventional manner in which the waste toner is used again, image defects according to the toner adhesion to the background can be prevented beforehand.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

Figure 1:
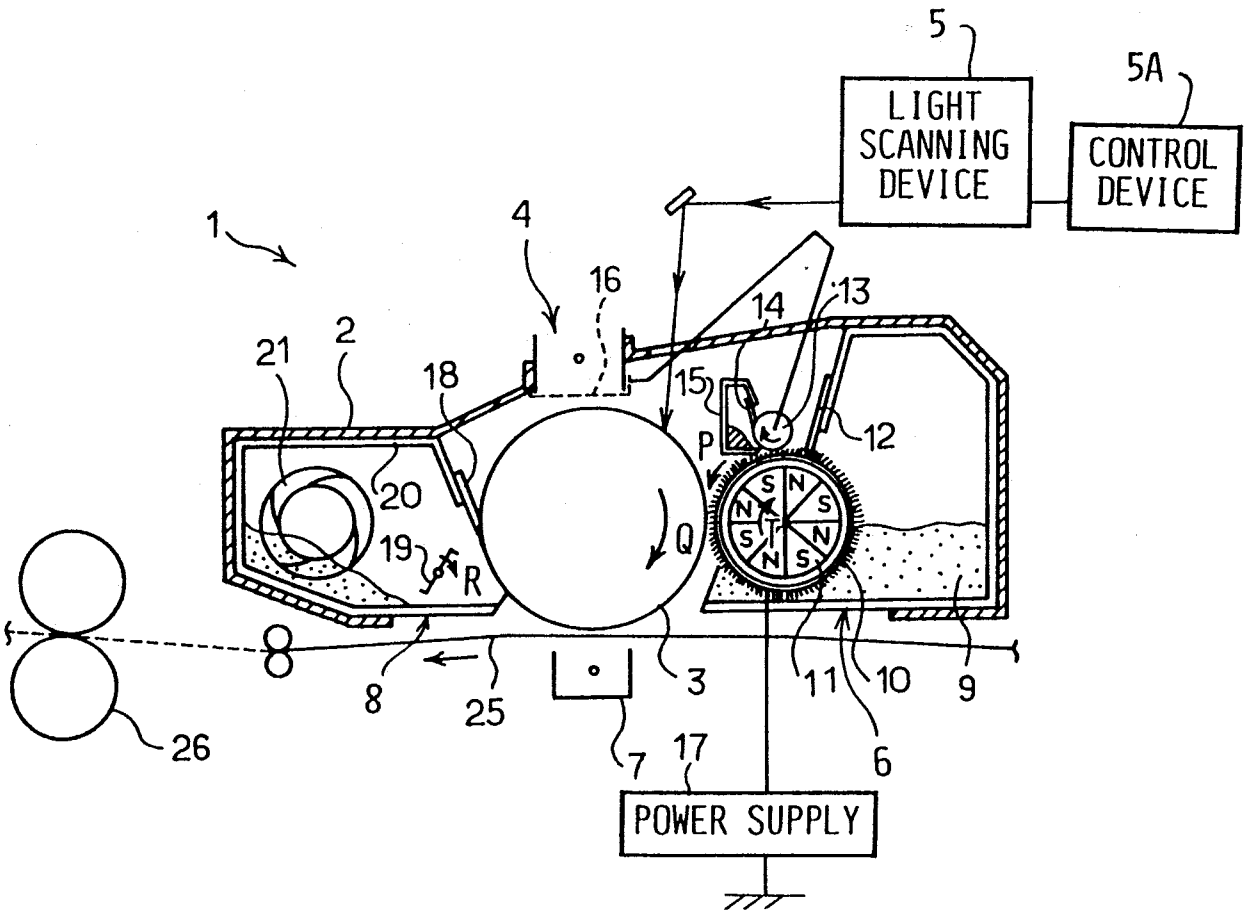
FIG. 1 is a cross-sectional view of a process unit which embodies the present invention.
Figure 2:
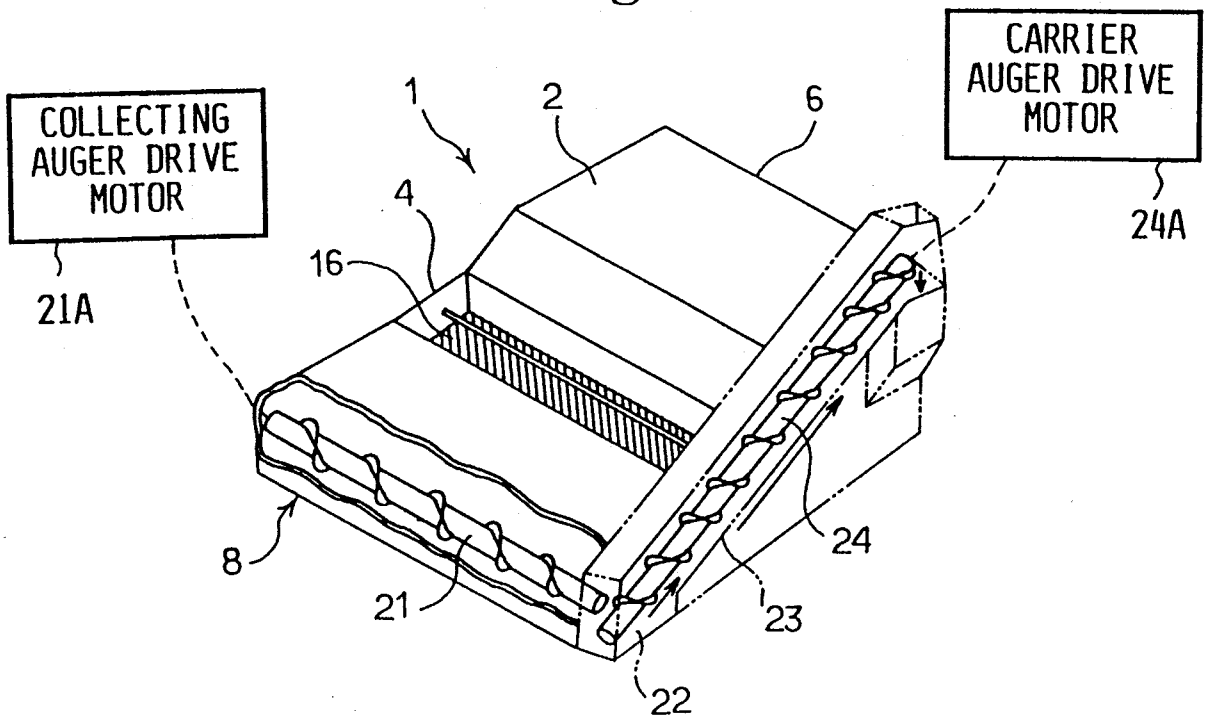
FIG. 2 is a perspective view of a case which supports this process unit which is partially removed.

Hereinafter, a process unit which embodies the present invention will be explained with reference to the drawings. FIG. 1 shows a construction in the installation of this process unit to the electrophotographic apparatus etc., and FIG. 2 shows the exterior of the case of the device which installs this process unit. A process unit 1 installed on the electrophotographic apparatus main body is supported by a case 2 which is in the apparatus. A part of this process unit 1 is constructed by a photosensitive drum 3, a scorotron charger 4, a development device 6, and a cleaning device 8. The photosensitive drum 3 is formed by a cylinder type conductive base substance such as aluminum on which a photoconductive material is coated. The scorotron charger 4, a light scanning device 5, the development device 6, a corotron transfer device 7, and the cleaning device 8 are arranged according to the rotational direction indicated by the arrow Q in FIG. 1 around the photosensitive drum 3. The development device 6 stores magnetic toner particles 9 and has a developing sleeve 10 which rotates in a direction indicated by the arrow P in FIG. 1, and carries the magnetic toner particles 9 to the photosensitive drum 3 when a latent image on the drum 3 is developed. A magnet roll 11 is arranged in the developing sleeve 10. The magnet roll 11 is supported to rotate around the same shaft as the developing sleeve 10 in an opposite direction indicated by the arrow T in FIG. 1. Further, the development device 6 has a trimming blade 12 which restricts the toner particles layer thickness on the developing sleeve 10. Moreover, in a development area where the trimming blade 12, the developing sleeve 10 and the photosensitive drum 3 are facing respectively and near the developing sleeve 10, a bias applying roller 13 rotatably supported, a scraper 14 contacting the bias applying roller 13 and a container 15 in which the bias applying roller 13 and the scraper 14 are supported are arranged. The bias applying roller 13 is formed by a material such as conductive rubber and is electrically connected to a grid 16 of the scorotron charger 4. The scraper 14 is formed of any material having an adequate hardness, such as urethane rubber.

The developing sleeve 10 is formed of a conductive material such as cylinder type aluminum in order to easily apply the voltage. A sand blasting treatment (process for applying some ruggedness to the surface of the sleeve) for creating a surface roughness of about 5 microns is performed so that the toner particles on the surface of the sleeve 10 may be easily carried and charged. Moreover, a power supply 17 is provided as a voltage applying unit. The cleaning device 8 contains a cleaning blade 18 for removing residual toner particles on the photosensitive drum 3, an agitator 19, and a cleaning box 20 which supports the above blade 18 and the agitator 19 and stores removed toner particles therein. A collecting auger 21 is provided in the cleaning box 20, and a collecting container 22 is provided on the side of the cleaning box 20. Moreover, a toner particle carrying path 23 is provided between the collecting container 22 and the development device 6, and a carrier auger 24 is provided in the toner particle carrying path 23. Each of the collecting auger 21 and the carrier auger 24 is driven by a collecting auger drive motor 21A and a carrier auger drive motor 24A, respectively.

The magnetic toner particles 9 to be used are constructed in the same manner as the above-mentioned magnetic toner particles 39.

Next, the movement of the electrophotographic apparatus on which the above-mentioned process unit 1 is installed is explained. First, the surface of the photosensitive drum 3 is uniformly charged to a predetermined polarity and potential by the scorotron charger 4. The light scanning device 5 exposes the photosensitive drum 3 based on an image signal from a control device 5A, and an electrostatic latent image is formed thereon. This latent image is developed to create a visible image by the development device 6, and the image is transferred on a sheet 25 by the corotron transfer device 7. The image transferred on the sheet 25 is fixed with a fixing device 26 and is output from a sheet outlet (not shown). On the other hand, foreign matter such as residual toner particles adhered on the surface of the photosensitive drum 3 after the transfer, and paper powder from the sheet 25 are removed by the cleaning device 8, and the photosensitive drum 3 is charged again by the scorotron charger 4 and the above-mentioned movement is repeated.

The residual toner particles on the photosensitive drum 3 are scratched with the cleaning blade 18, and fall into the cleaning box 20. The cleaning blade 18, made of a polyurethane rubber having excellent ozonization resistance and abrasion resistance, is used, and its edge is finished to uniformly contact the surface of the drum 3. Further, a free edge of the cleaning blade 18 is arranged to extend in a direction reverse to the rotating direction indicated by the arrow Q of the photosensitive drum 3, and the toner particles on the photosensitive drum 3 are scratched and removed by adding constant pressure to the cleaning blade 18. The toner particles which fall in the cleaning box 20 are carried into the inner part of the cleaning box 20 by rotation of an agitator 19 in the direction indicated by the arrow R and are stored therein. The waste toner saved in the cleaning box 20 is carried into the collecting container 22 by the collecting auger 21, and further, is returned to the development device 6 through the toner particle carrying path 23 by the carrier auger 24, and is used for development again.

When the electrostatic latent image formed on the photosensitive drum 3 is developed to create a visible image by the magnetic toner particles 9, as mentioned above, the additives on the surface of the toner particles 9 are charged to a polarity which is opposite to the polarity of the toner particles 9. Therefore, in general, the additives are not easily transferred even if they are adhered in the non-image portion on the photosensitive drum 3 when developed. The additives are removed by the mechanical and electrical power in the developing part, and are dropped by the cleaning blade 18 and collected in the cleaning box 20. Therefore, the amount of the additives in the waste toner particles stored in the cleaning box 20 increases compared with the toner particles of an initial condition, and the foreign matter such as the paper powder from the sheet 25 are also admixed therein. As a result, the waste toner particles become unsuitable for development.

Figure 3:
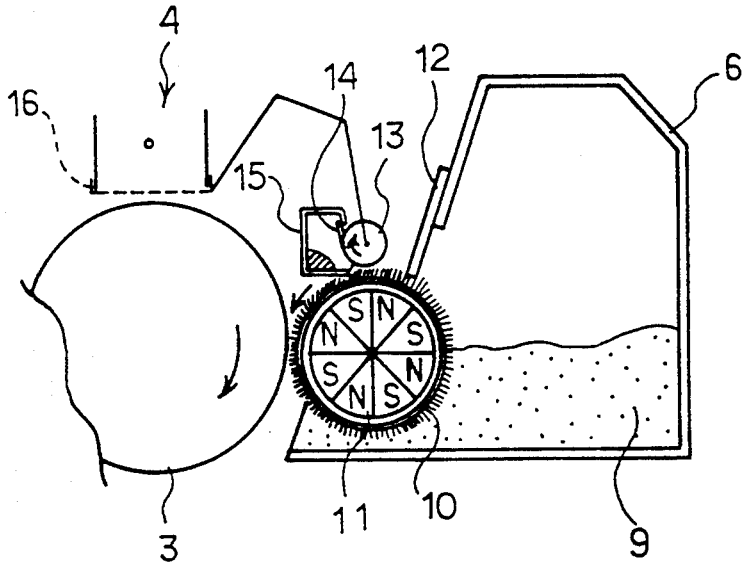
FIG. 3 is a cross-sectional view of the development device of the process unit.

Next, the movement of the development device 6 when the waste toner particles are used again is explained with reference to FIG. 3. The mixture of magnetic toner particles 9 of unused toner particles and the collected waste toner particles are stored in the development device 6. The magnetic toner particles 9 are adhered on the developing sleeve 10 by the magnetic force of the magnet roll 11. The adhered magnetic toner particles 9 are carried by the rotation of the developing sleeve 10 and the magnet roll 11 in the direction indicated by the arrow P. The amount of the toner particles 9 on developing sleeve 10 are restricted by the trimming blade 12. Then, the above mentioned toner particles and the additives which are charged in positive polarity and are not suitable for development are collected from the magnetic toner particles 9 on the developing sleeve 10 by the bias applying roller 13. The electrostatic latent image on the photosensitive drum 3 is developed to create a visible image with the toner particles from which the elements which are not suitable for development have been removed.

Figure 4:
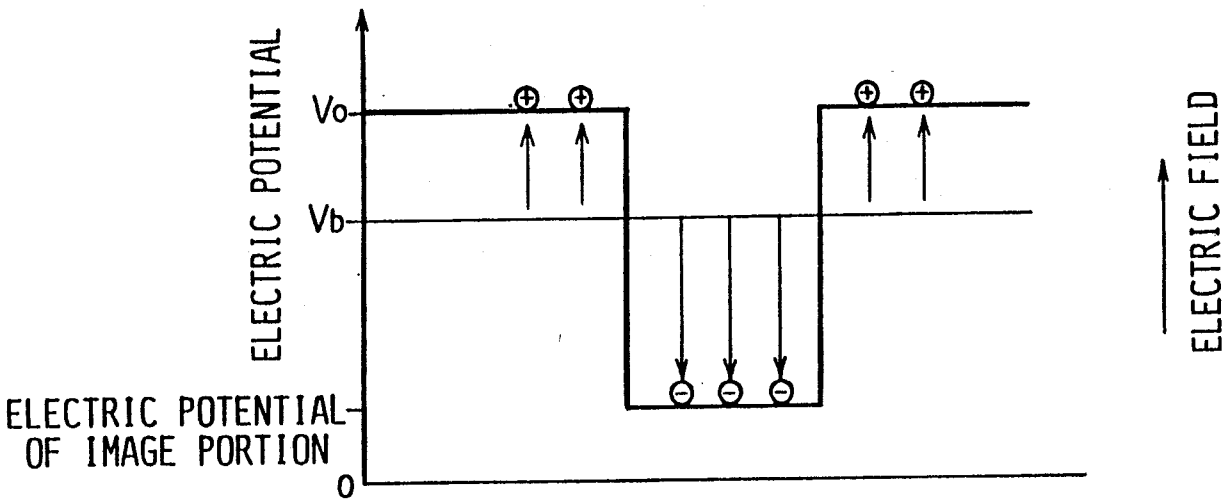
FIG. 4 illustrates the relation of the potential of the development device and each part of a photosensitive drum.
Figure 5:
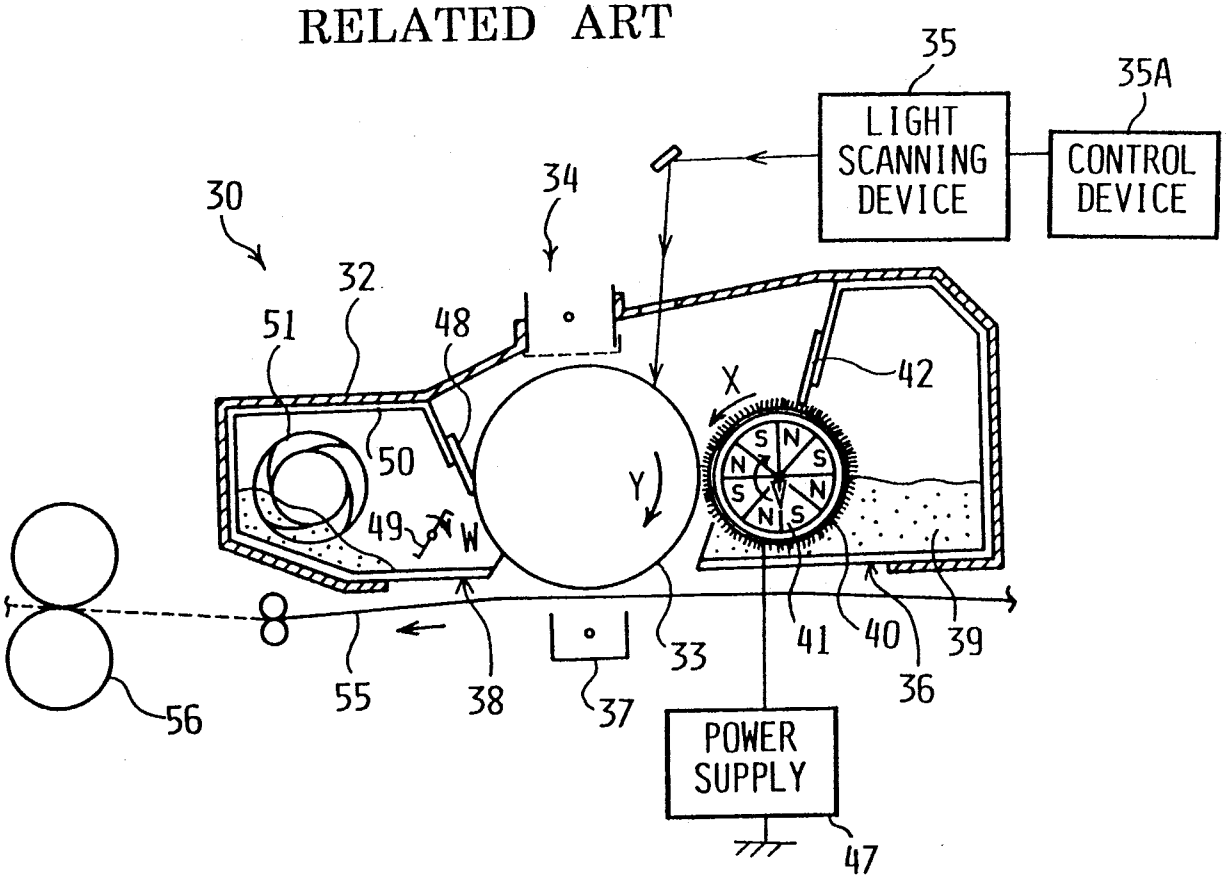
Fig.5 RELATED ART
FIG. 5 is a cross-sectional view of a conventional process unit.
Figure 6:
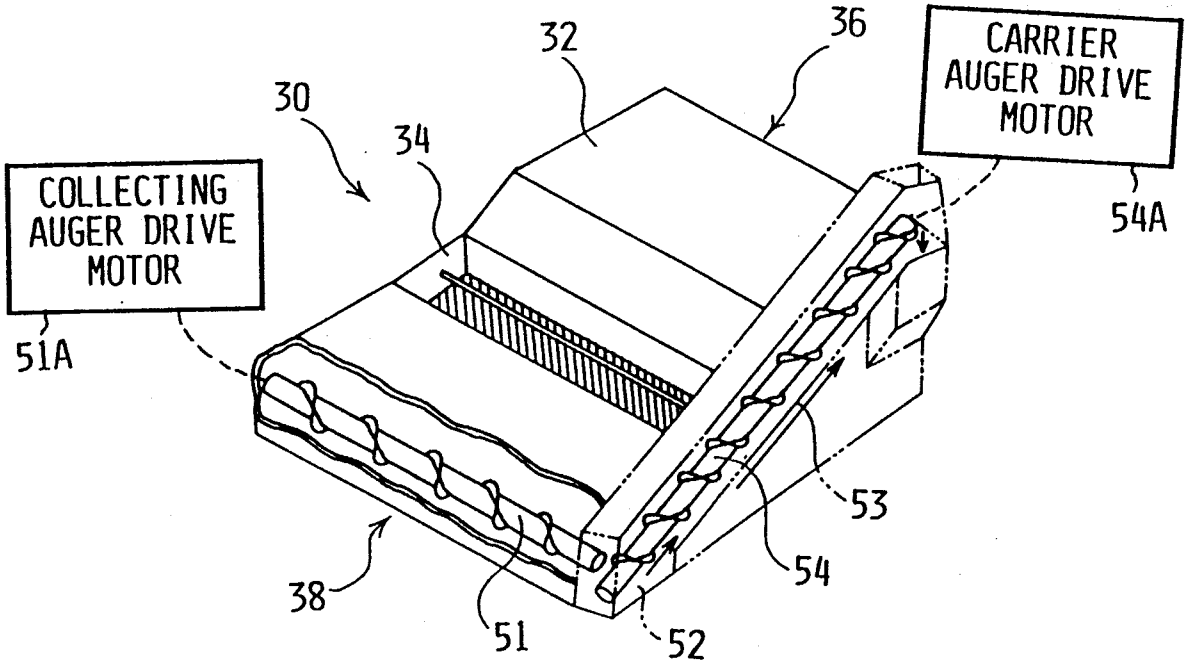
Fig.6 RELATED ART
FIG. 6 is a perspective view of a case which supports conventional process unit which is partially removed.

Next, the relation between a potential Vb applied to the developing sleeve 10 and a potential Vo applied to the bias applying roller 13, and the potential distribution of the electrostatic latent image on the photosensitive drum 3 are shown in FIG. 4. The same potential as the potential of the grid 16 of the scorotron charger 4 is applied to the bias applying roller 13. Therefore, the surface potential of the bias applying roller 13 is substantially the same as the surface potential of the non-image portion of the photosensitive drum 3, namely, the part which is not exposed by the light scanning device 5. Therefore, the toner particles and additives on the toner surface which are charged to a positive polarity and are not suitable for development are transported from the developing sleeve 10 and are adhered on the bias applying roller 13 by the electric field. The toner particles and the additives on the toner surface adhered on the bias applying roller 13 are scratched, are removed by the scraper 14, and are stored in the container 15.

The toner particles and the additives on the toner surface having elements which are not suitable for development are collected by the bias applying roller 13 provided on the upstream side of the development area, so that they are not adhered to the non-image portion of an electrostatic latent image which is supported on the photosensitive drum 3. Therefore, by providing the bias applying roller 13 as mentioned above, the image defect caused by the toner adhesion of the background which is conspicuously caused in the conventional process unit can be prevented.

It is to be understood that the present invention is not restricted to the particular forms shown in the foregoing embodiment, and various modifications and alterations can be added thereto without departing from the scope of the inventions encompassed by the appended claims.

For instance, in the above-mentioned embodiment, the grid voltage of the scorotron charger 4 was used as a voltage for application to the bias applying roller 13, but it is possible to include a separate power supply for applying the voltage. Moreover, an alternating voltage can be superimposed to such a voltage.

Moreover, in the above-mentioned embodiment, the development method with one element magnetic toner particles was disclosed. However, even if it is used for non-magnetic toner particles, and even if it performs another development method using a carrier which is constructed by magnetic grains such as ferrite and magnetite and whose particle diameters are about 50–100 microns, it will be covered by the present invention as far as it uses the method to re-use the waste toner.

Moreover, in the above-mentioned embodiment, the bias applying roller is arranged just before the development area. However, it can be arranged in the waste toner carrying path, thereby toner particles and the additives on the toner surface which are not suitable for the development can be collected before the waste toner is returned to the development device.

What is claimed is:

1. A printer for recording an image on a recording medium by a developer, comprising:

an image forming apparatus body;

means for making a latent image on said image forming apparatus body;

development means for developing the latent image on said image forming apparatus body to create a visible image by using developer, said development means developing the latent image for creation of the visible image by a transferring mechanism;

cleaning means for removing residual developer on said image forming apparatus body after developing, said cleaning means storing the removed developer therein;

carrying means for carrying the developer in said cleaning means to said development means; and collecting means for selectively collecting an element present in the developer which is not suitable for development from the residual developer removed from the image forming apparatus body by the cleaning means, said collecting means comprising a bias applying member having a potential applied thereto, said potential being the same as a surface potential of a non-image portion of said image forming apparatus body, said element adhering to said bias applying member.

2. The printer as claimed in claim 1, wherein said means for making a latent image contains an exposure device.

3. The printer as claimed in claim 1, wherein said developer means contains a conveying device for conveying the developer close to the image forming apparatus body.

4. The printer as claimed in claim 3, wherein said collecting means selectively collects said element from the developer carried by said carrying means to said development means.

5. The printer as claimed in claim 4, wherein said collecting means is located just before a development area where the latent image on said image forming apparatus body is developed by the developer.

6. The printer as claimed in claim 1, wherein said collecting means further comprises a scraper for scraping said element from said bias applying member and a container for storing said scraped element.

7. The printer as claimed in claim 6, wherein said bias applying member is a rotatably supported bias applying roller.

8. A printer for recording an image on a recording medium by a developer, comprising:

a photosensitive member;

exposure means for making a latent image on said photosensitive member;

storing means for storing developer which is used for developing the latent image on said photosensitive member to create a visible image;

conveying means for conveying the developer which is stored in said storing means close to said photosensitive member;

first means for generating an electric field between said photosensitive member and conveying means to develop the latent image with the conveyed developer;

cleaning means for removing residual developer on said photosensitive member after developing, said cleaning means storing the removed developer therein;

carrying means for carrying the residual developer in said cleaning means to said storing means;

collecting means for collecting an element which is not suitable for development in said storing means; and second means for generating an electric field between said conveying means and said collecting means, the electric field generated by said second means being substantially the same as the electric field generated by said first means between said conveying means and the surface of a non-image portion on said photosensitive member.

9. The printer as claimed in claim 8, wherein said collecting means is located just before a development area where the latent image on said photosensitive member is developed by the developer.

10. The printer as claimed in claim 8, wherein said collecting means is located separate from said conveying means by a certain distance, the distance between said collecting means and said conveying means being substantially the same as the distance between said photosensitive member and said conveying means.

11. The printer as claimed in claim 8, wherein said developer comprises one of magnetic and non-magnetic toner particles.

12. The printer as claimed in claim 8, wherein said cleaning means has a cleaning blade for removing the developer which remains on said photosensitive member.

13. The printer as claimed in claim 12, wherein said photosensitive member is a photosensitive drum.

14. The printer as claimed in claim 13, wherein said cleaning blade is formed of a polyurethane rubber having ozonization resistance and abrasion resistance.

15. The printer as claimed in claim 8, wherein said collecting means comprises a rotatably supported bias applying member, a scraper positioned to contact the bias applying member and a container in which said applying member and said scraper are supported.

16. The printer as claimed in claim 15, wherein said bias applying member is formed of conductive rubber.

17. The printer as claimed in claim 15, wherein said scraper is formed of a urethane rubber material.

18. The printer as claimed in claim 15, wherein said bias applying member is located separate from said conveying means by a certain distance, the distance between said bias applying member and said conveying means being substantially the same as the distance between said photosensitive member and said conveying means.

* * * * *